US012529271B2

(12) United States Patent
Pereira Magalhães et al.

(10) Patent No.: US 12,529,271 B2
(45) Date of Patent: Jan. 20, 2026

(54) HANGING-OFF ELONGATE ELEMENTS DURING OFFSHORE OPERATIONS

(71) Applicant: Subsea 7 do Brasil Servicos Ltda., Niterói (BR)

(72) Inventors: Guilherme Pereira Magalhães, Niterói (BR); João Luiz Vaz Coelho, Copacabana (BR)

(73) Assignee: Subsea 7 do Brasil Servicos Ltda., Niterói (BR)

( * ) Notice: Subject to any disclaimer, the term of this patent is extended or adjusted under 35 U.S.C. 154(b) by 0 days.

(21) Appl. No.: 18/710,748

(22) PCT Filed: Nov. 17, 2022

(86) PCT No.: PCT/BR2022/050446
§ 371 (c)(1),
(2) Date: May 16, 2024

(87) PCT Pub. No.: WO2023/087089
PCT Pub. Date: May 25, 2023

(65) Prior Publication Data

US 2025/0052119 A1 Feb. 13, 2025

(30) Foreign Application Priority Data

Nov. 19, 2021 (GB) ..... 2116734

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/102
See application file for complete search history.

(56) References Cited

U.S. PATENT DOCUMENTS 250,638 A * 12/1881 Barker ..... G01B 5/207 33/561.1
787,142 A * 4/1905 Barnett ..... G01B 5/207 33/561.1
1,041,145 A * 10/1912 Moss ..... G01B 5/207 33/561.1

(Continued)

FOREIGN PATENT DOCUMENTS

CN 109236205 B * 8/2020 ..... E21B 19/06
EP 2480810 B1 3/2017

(Continued)

OTHER PUBLICATIONS

Machine translation of CN 109236205 B (Liu) (Year: 2020).*

(Continued)

*Primary Examiner* — Blake Michener
(74) *Attorney, Agent, or Firm* — Mattingly & Malur, PC

(57) ABSTRACT

A hang-off system comprises support blocks that are movable toward a launch axis for engagement with an elongate element such as a flexible pipeline being laid from a vessel into water. Each support block comprises an array of plates that together define an engagement face of the support block and are movable relative to each other to conform a contour of the engagement face to a contour of the element.

33 Claims, 13 Drawing Sheets

(56) References Cited

U.S. PATENT DOCUMENTS

| | | | | |
|---|---|---|---|---|
| 1,261,438 | A * | 4/1918 | Reinhardt | G01B 5/20 33/561.1 |
| 2,741,033 | A | 4/1956 | Amato et al. | |
| D884,501 | S * | 5/2020 | Lei | D10/65 |
| 2009/0229424 | A1 | 9/2009 | Montgomery et al. | |
| 2014/0166297 | A1* | 6/2014 | Kubichek | E21B 19/004 166/355 |
| 2016/0084064 | A1* | 3/2016 | Clemens | E21B 47/09 166/301 |

FOREIGN PATENT DOCUMENTS

| | | | |
|---|---|---|---|
| GB | 1352983 | A | 5/1974 |
| GB | 2531931 | A | 5/2016 |
| GB | 2591771 | A | 8/2021 |
| WO | 2011/080459 | A1 | 7/2011 |
| WO | 2017/139861 | A1 | 8/2017 |
| WO | 2018/073453 | A1 | 4/2018 |
| WO | 2018/147735 | A1 | 8/2018 |
| WO | 2020/075126 | A1 | 4/2020 |

OTHER PUBLICATIONS

Machine translation of WO 2011/080459 (Year: 2011).*
International Search Report of PCT/BR2022/050446 dated Feb. 8, 2023.

* cited by examiner

HANGING-OFF ELONGATE ELEMENTS DURING OFFSHORE OPERATIONS

This invention relates to suspending an elongate element from a surface vessel during an offshore operation, for example when constructing underwater installations in the subsea oil and gas industry or in the marine renewable energy industry. An example of such an element is a subsea pipeline, a cable or an umbilical that hangs as a catenary from a surface vessel toward the seabed during installation. In the art of offshore operations, supporting such an element may be referred to as 'hanging off' or 'holding back', depending upon the phase of the installation operation.

As explained in WO 2017/139861 to the Applicant, flexible elongate elements such as flexible pipelines are most commonly laid underwater by an installation vessel that firstly spools the element onto a reel or carousel. During installation offshore, the element is unspooled from the reel or carousel and is then overboarded into the sea to hang from the vessel as a catenary. Rigid pipelines can also be laid by this reel-lay technique if the pipeline is straightened after unspooling to reverse plastic deformation imparted to the pipeline by spooling. In this respect, the invention is primarily concerned with flexible elements such as flexible pipelines but in a broad sense, the principles of the invention can also be used with rigid pipelines launched into the sea along an upright launch axis.

Between unspooling and overboarding, the elongate element passes over structures that guide the element, such as a tower, a chute or a ramp, and through various items of equipment that may contribute to hold-back tension, such as aligners, straighteners or tensioners. The inclination of a tower, chute or ramp may be adjustable, for example on a vessel fitted with a tilting lay tower whose inclination may depart from the vertical.

Frictional hold-back devices such as tensioners or friction clamps can be used to support the suspended weight of an elongate element. Examples of such devices may be found in WO 2018/147735, WO 2020/075126, WO 2018/073453, GB 2591771, GB 1352983 and US 2009/229424. However, the reliance of such devices upon friction means that there is nothing else to hold the element if it starts to slip through the device, for example because the outer surface of the element has a poor surface finish or is wet or oily. Also, hold-back devices have to be moved away from the launch axis of the element to allow laterally-protruding equipment that is wider than the remainder of the element, such as accessories or modules, to be attached to the element and to allow such equipment to bypass the hold-back device in the launch direction.

Installation of elongate elements on the seabed in deep water requires the installation vessel to have sufficient hang-off capacity to support the weight of the long catenary that is suspended in the water column between the vessel and the seabed. Usually, hang-off systems are used to keep the upper end of the element supported at deck level for connection to equipment such as in-line modules before deployment and also for connection between ends of pipeline sections during an installation campaign. In those situations, the element has to be suspended temporarily without moving in the launch direction.

It is conventional for a laterally protruding hang-off feature of an elongate element to be engaged mechanically with a hang-off plate or bushing on the pipelaying vessel. The element may hang from such a hang-off structure through a moonpool of the vessel or over the side or stern of the vessel. The laterally protruding hang-off feature that abuts a shoulder of the hang-off bushing may be a flanged collar or another item of equipment that is wider than the remainder of the element, such as an accessory or a module attached to the element. This provides a steady and reliable mechanical connection between the element and the laying equipment of the vessel.

For example, a hang-off collar may be a metallic part of the elongate element that defines a radially-projecting flange or ring. Examples are a forged radially-projecting ring that is incorporated into the element, or forgings comprising such rings that are attached to an end of the element or incorporated at intervals along the element. Other specific examples of equipment that has a greater diameter than the remainder of the element are a connector, an end fitting or an armour pot.

An example of a conventional hang-off system of the prior art is shown in FIG. 1 of the accompanying drawings. An elongate element 10 that is exemplified here as a flexible pipeline extends along a generally vertical launch axis as it passes through the hang-off system 12. The hang-off system 12 comprises a tubular support structure 14 whose inner opening flares downwardly to accommodate bending of the elongate element 10.

The elongate element 10 carries an armour pot 16 as an example of a laterally-protruding hang-off feature. The element 10 further comprises a vertebrae bend restrictor 18 extending from the armour pot 16.

The open top of the tubular support structure 14 is closed by a hang-off bushing 20 that is assembled in two halves around the elongate element 10 and so has a central hole 22 to accommodate the element 10.

A simple hang-off bushing 20 like that shown in FIG. 1 can only accommodate one diameter of elongate element 10: in other words, a hang-off bushing 20 cannot be purpose-designed as a universal hang-off insert for all such elements 10. Consequently, it is conventional to use one of a selection of split hang-off inserts 24 as an adaptor between a specific element 10 and a hang-off bushing 20. The inner edge region of the hang-off bushing 20 around the central hole 22 serves as a shoulder upon which the hang-off insert 24 rests.

The hang-off insert 24 is made of semi-circular or half-moon parts machined from steel, whose internal curvature matches the external curvature of a particular elongate element 10. The two parts of the hang-off insert 24 are bolted together around the element 10 to lie between the element 10 and the hang-off bushing 20. The armour pot 16 sits on the hang-off insert 24. This transfers the weight of the element 10 to the hang-off bushing 20 through the hang-off insert 24.

As noted above, the armour pot 16 is just an example of a hang-off feature protruding laterally from the elongate element 10. Such a feature may be provided by any other equipment that has a greater diameter than the remainder of the element 10, or by a flanged collar protruding radially from the element 10.

An installation vessel may have to cater for elongate elements 10 of many different diameters during routine operations. Each diameter of element 10 requires a different hang-off insert 24. Consequently, around fifty different hang-off inserts 24 may be required per vessel. This involves a high cost of design and fabrication and requires a large area of deck space on the vessel to store multiple hang-off inserts 24 onboard. Alternatively, there is a risk of expensive downtime to fabricate or obtain a specific hang-off insert 24 if such an insert is not kept onboard.

To mitigate these drawbacks of conventional prior art, WO 2017/139861 discloses a hang-off insert in the form of a circular loop that comprises circumferentially-spaced support segments. Collectively, the segments define a substantially planar support face of the insert and have respective radially inner faces that define an inner radius of the loop. The radially inner faces of the support segments can be positioned at various radial positions to determine the inner radius of the loop and hence to adapt the circumference of the loop to suit different diameters of elongate subsea elements.

With the hang-off insert supported by a hang-off structure of the vessel, a laterally-protruding hang-off feature of the elongate element extending through the loop may be rested on the support face to transfer suspended weight loads through the insert to the hang-off structure.

FIG. 2 illustrates a hang-off system 26 comprising a hang-off insert 28 as taught by WO 2017/139861, in place of the rigid split hang-off insert 24 of the prior art as shown in FIG. 1. Otherwise, the hang-off system 26 of FIG. 2 is similar to the hang-off system 12 of FIG. 1, so like numerals are used for like features.

The hang-off insert 28 is tightened around and encircles an elongate element 10, again exemplified here as a flexible pipeline of circular cross-section that extends along a generally vertical launch axis as it passes through the hang-off system 26.

As in the hang-off system 12 shown in FIG. 1, the hang-off system 26 shown in FIG. 2 comprises a tubular support structure 14 whose open top may be closed by a hang-off bushing 20 that is assembled in two halves around the elongate element 10. The hang-off bushing 20 has a central hole 22 to accommodate the elongate element 10.

The inner edge region of the hang-off bushing 20 around the central hole 22 serves as a shoulder upon which the hang-off insert 28 rests. In use of the invention, a laterally-protruding hang-off feature of the elongate element 10 such as an armour pot 16 as shown in FIG. 1 (which has been omitted from FIG. 2 for clarity) rests in turn on the hang-off insert 28 to transfer loads of the elongate element 10 through the hang-off insert 28 to the hang-off bushing 20.

Against this background, the invention resides in a hang-off system comprising at least one support block that is movable forwardly toward a launch axis for engagement with an elongate element being laid from a vessel into water. The or each support block comprises an array of plates that together define an engagement face of the support block and are movable relative to each other to conform a contour of the engagement face to a contour of the element. Each plate comprises mutually parallel upright side faces joined by an upper face that is narrower than either of the side faces of that plate and the upper faces of the plates together define an upper face of the support block.

Each plate may comprise a lower face that is parallel to the upper face, the lower faces of the plates together defining a lower face of the support block.

The side faces of each plate may also be joined by a front face, the front faces of the plates together defining the engagement face of the support block. The engagement face of the support block may be inclined forwardly and upwardly toward an upper leading edge of the block.

The front face of each plate may be shaped to define a facet that is angled acutely relative to a plane of a side face. The facets of one subset of the plates may be in mirror relation to the facets of another subset of the plates, such that the facets of both of those subsets face toward the launch axis. The subsets may be separated by an upright plane that bisects the support block and that contains the launch axis.

The plates can be moved relative to each other in respective upright planes, which planes may be mutually parallel and parallel to a plane containing the launch axis.

A housing may constrain the plates against movement transverse to the forward direction. For example, the housing may comprise side walls disposed on respective sides of the support block that constrain lateral movement of the plates. The housing may further comprise a top wall disposed above the support block that constrains upward movement of the plate. The housing may define an aperture through which the support block can be advanced forwardly from the housing.

Actuators may act on the block portions to drive forward movement of the block portions. It is also possible for the block portions to be biased forwardly, for example by springs.

Conveniently, the support block can be mounted on a jaw of a hang-off bushing, for example via a housing fixed to that jaw. The support block may be movable relative to the jaw of the hang-off bushing. For example, the support block may be movable forwardly or be pivotable about horizontal and/or vertical axes relative to the jaw of the hang-off bushing.

The inventive concept embraces a lay system or a vessel comprising the hang-off system of the invention. The inventive concept also extends to a corresponding method of hanging-off an elongate element being laid from a vessel into water. The method comprises advancing first and second portions of a support block into contact with the element beneath an outwardly-projecting formation of the element wherein the first and second portions are advanced in parallel planes; effecting relative displacement between those portions to conform a contour of the support block to an abutting contour of the elongate element; and hanging-off the element from the portions of the support block in contact with an underside of the outwardly-projecting formation.

Relative displacement between the portions of the support block may take place after bringing the first portion into contact with the element. For example, the first portion of the support block may be advanced into contact with the element and then, with the first portion stationary relative to the element, the second portion of the support block may be advanced into contact with the element. Alternatively, relative displacement between the portions of the support block may take place before bringing either portion into contact with the element. In either case, relative displacement may involve advancing a leading edge of the second portion beyond a leading edge of the first portion.

The portions of the support block are preferably advanced in directions parallel to an upright plane containing a launch axis of the element. The portions of the support block are preferably constrained against transverse movement and/or upward movement.

Movement of the portions of the support block may be driven individually. The portions of the support block may be biased toward the element, in which case relative movement between the portions may be effected against that bias.

The support block may be moved with and/or relative to a supporting jaw of a hang-off bushing, for example by translational movement or pivotal movement of the support block about horizontal and/or vertical axes relative to the supporting jaw.

Whilst the adaptable hang-off insert of WO 2017/139861 has significant advantages over the multiple hang-off inserts required by conventional prior art, the inventors have now addressed the problem of adapting a hang-off-system from a different perspective. Specifically, they have explored a fresh approach in which the hang-off structure itself can adapt to suit elongate elements of different diameters, without necessarily requiring an adaptable insert.

The invention contemplates that a hang-off structure such as a hang-off bushing can comprise a series or set of plates assembled in parallel to form a supporting block. Each plate can move independently of other plates of the set to change the shape of the block, particularly the shape or curvature of a face or an upper edge of the block that abuts an elongate element to be supported by the block. This adapts a leading end or edge of the set to complement the external diameter or shape of the element, which may include a fitting on the element such as an end fitting of a flexible pipeline.

Like WO 2017/139861, the invention solves the problem of providing a supporting interface between a hang-off structure and pipelines or other elongate elements, or their fittings, that are not standardised and so may have various shapes and diameters.

The invention provides a versatile alternative to hang-off inserts of the prior art. The solution of the invention can comply with a wide range of diameters of elongate elements that may be suspended from a hang-off structure and ensures a reliable mechanical interface between equipment of the element and the hang-off structure.

The invention improves safety because it requires no work to be performed under a suspended load. The invention also generates a considerable cost saving. By reducing the setup time for each hang-off operation by 25% to 30%, the invention could, on aggregate, save hundreds of thousands of US dollars of operational cost per vessel, per year. There is also a saving in the cost of fabricating bespoke hang-off inserts as sometimes required in the conventional prior art. Unlike the hang-off inserts of the prior art, apparatus of the invention can be assembled and disassembled, if ever necessary, without impacting the critical path of a laying operation. Also, preliminary results suggest that in comparison with a prior art solution, the invention could reduce loads on key components by 70% to 90%.

Embodiments of the invention provide a device for supporting a formation on a pipeline or other elongate element, such as a head or a termination of a flexible pipeline, during installation from a vertical or tiltable lay system, the device comprising at least two partial support boxes, each box comprising a plurality of vertical plates, each plate being able to slide horizontally to adjust the position of the top of the plate to the shape and diameter of the formation on the pipeline.

The plates may be biased or forced in the direction of the pipeline, for example by a hydraulic circuit, by jacks or by springs. The plates can also be tilted slightly in a vertical plane.

Each box may comprise four or five walls and one open side through which the plates can slide. The number of plates in a box may be determined by filling in the width of the open side with the sum of the thicknesses of the plates. The plates may be fully packed in the box.

The plates need not necessarily all have identical thickness. For example, outer or outermost plates may be thicker than inner or innermost plates, or vice versa.

The boxes may be mounted on mountings such as gimbals, pivots or rubber pads that are arranged to accommodate any misalignment of the flexible pipeline with the normal launch direction.

Embodiments of the invention also implement a method for supporting a formation of a flexible pipeline during installation from a vertical or tiltable lay system. The method comprises: providing boxes containing a plurality of vertical support plates; guiding the support plates around the trajectory of the flexible pipeline; adjusting the transverse positions of the plates by sliding them inside or relative to the respective boxes until the plates are in contact with the flexible pipeline or a bottom part of the formation; and then abutting the bottom of the formation with the top of the plates.

Thus, in embodiments of the invention, a hang-off system comprises support blocks that are movable toward a launch axis for engagement with an elongate element, such as a flexible pipeline, being laid from a vessel into water. Each support block comprises an array of plates or other block portions that together define an engagement face of the support block, adapted to engage the element. The plates are movable relative to each other to bring a contour of the engagement face into conformity with a contour of the element. Each plate comprises upright side faces joined by an upper face that is narrower than either of the side faces of that plate and the upper faces of the plates together define an upper face of the support block.

Reference has already been made to FIGS. 1 and 2 of the drawings to illustrate hang-off systems known in the prior art. In those drawings:

FIG. 1 is a side view in longitudinal section of a conventional hang-off system supporting an elongate element exemplified by a flexible pipe; and FIG. 2 is a top perspective view of a hang-off system disclosed in WO 2017/139861.

In order that the invention may be more readily understood, reference will now be made, by way of example, to the remainder of the accompanying drawings, in which:

FIG. 3 is a schematic perspective view of a support block of the invention mounted on a hang-off structure and engaging an end fitting of a pipeline;

FIG. 4 corresponds to FIG. 3 but shows a pair of support blocks acting on the end fitting in mutual opposition;

Figure 1:
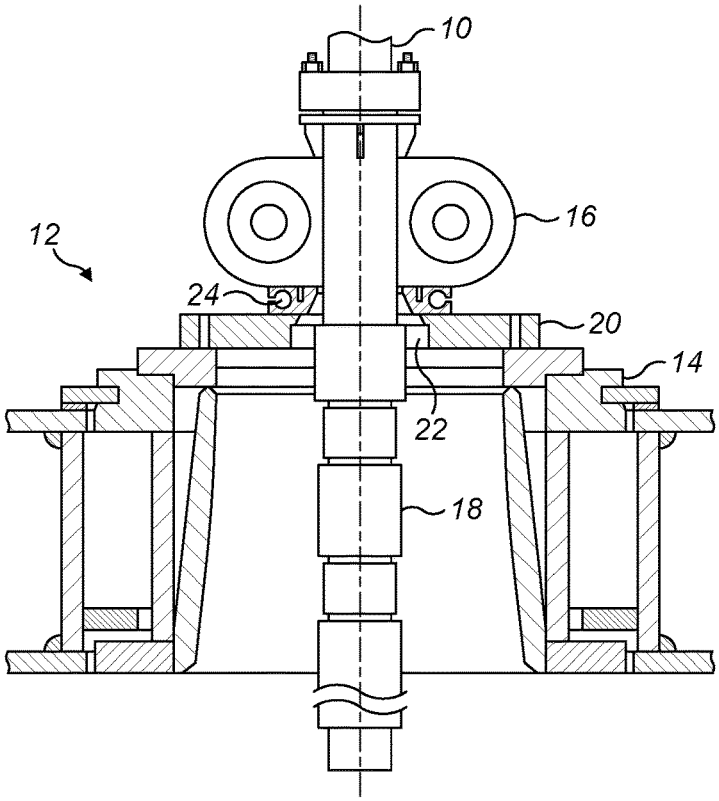
FIG. 1 Prior Art
Figure 2:
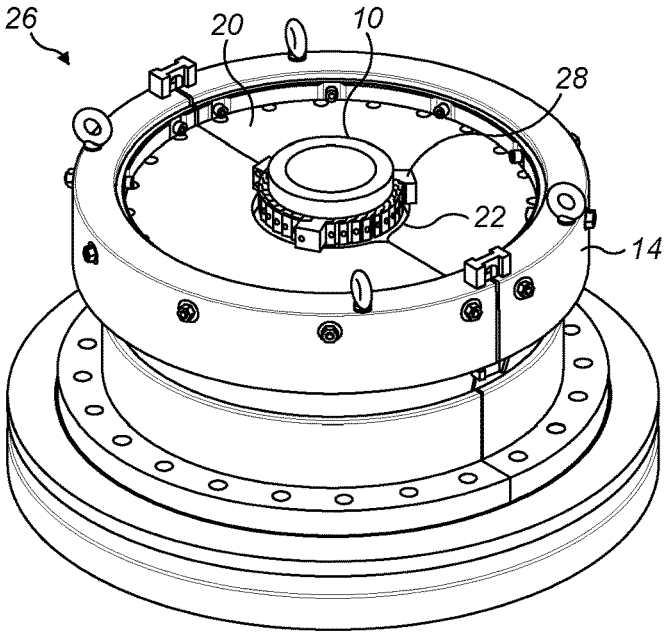
FIG. 2 Prior Art
Figure 3:
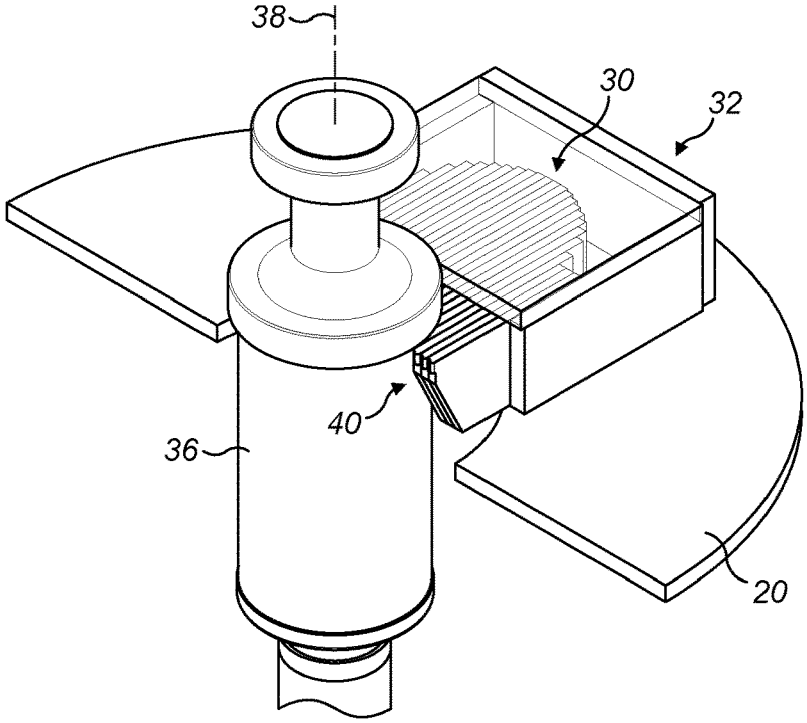
Figure 4:
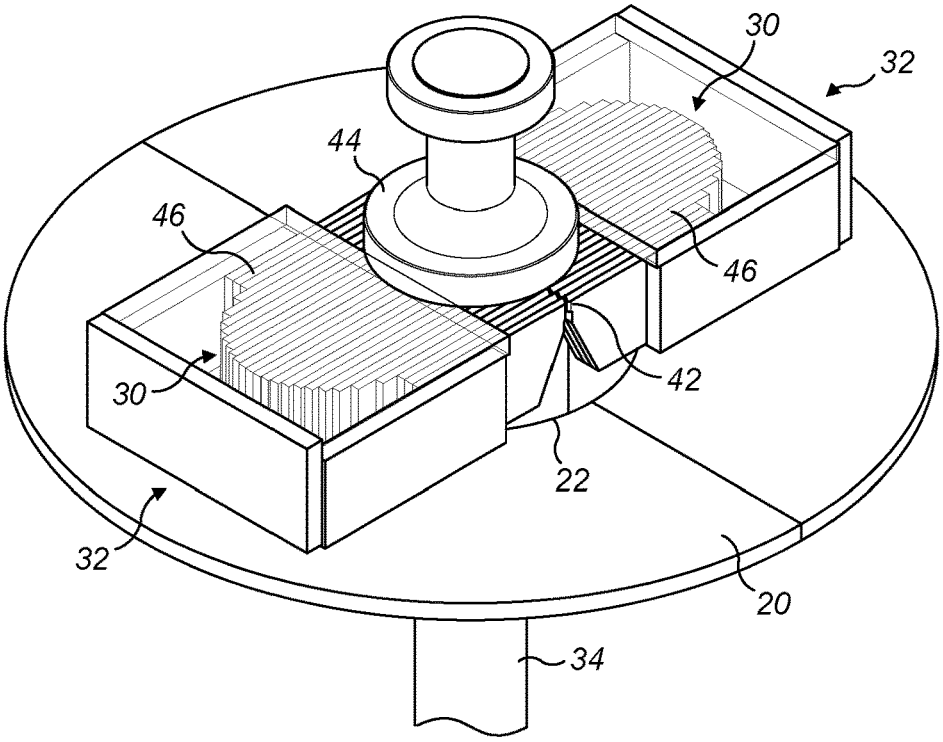
Figure 5:
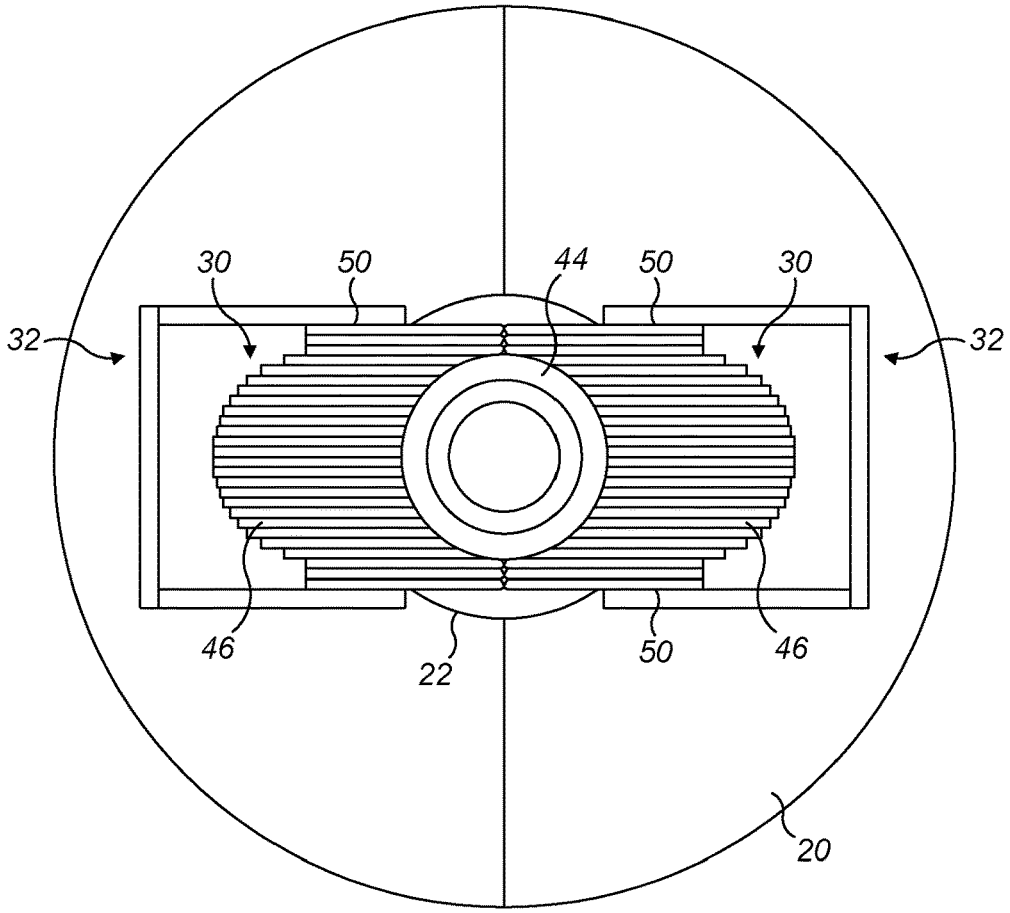
FIG. 5 is a schematic top plan view corresponding to FIG. 4.
Figure 6:
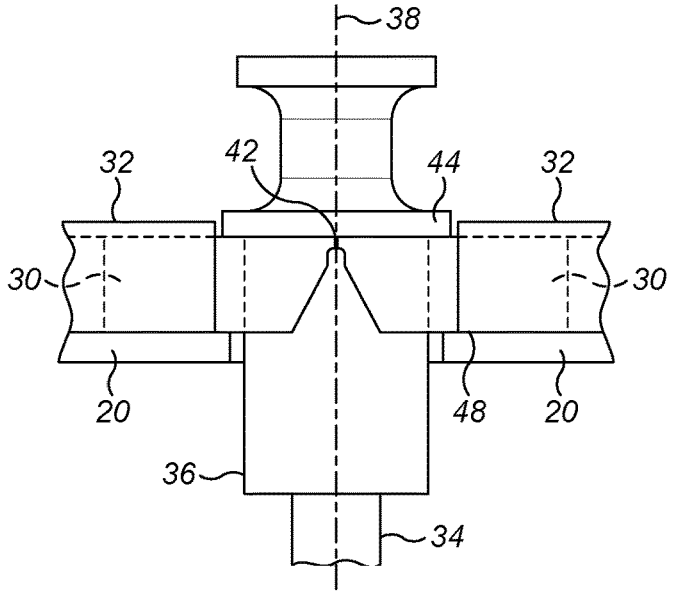
FIG. 6 is a schematic side view corresponding to FIGS. 4 and 5.
Figure 11A:
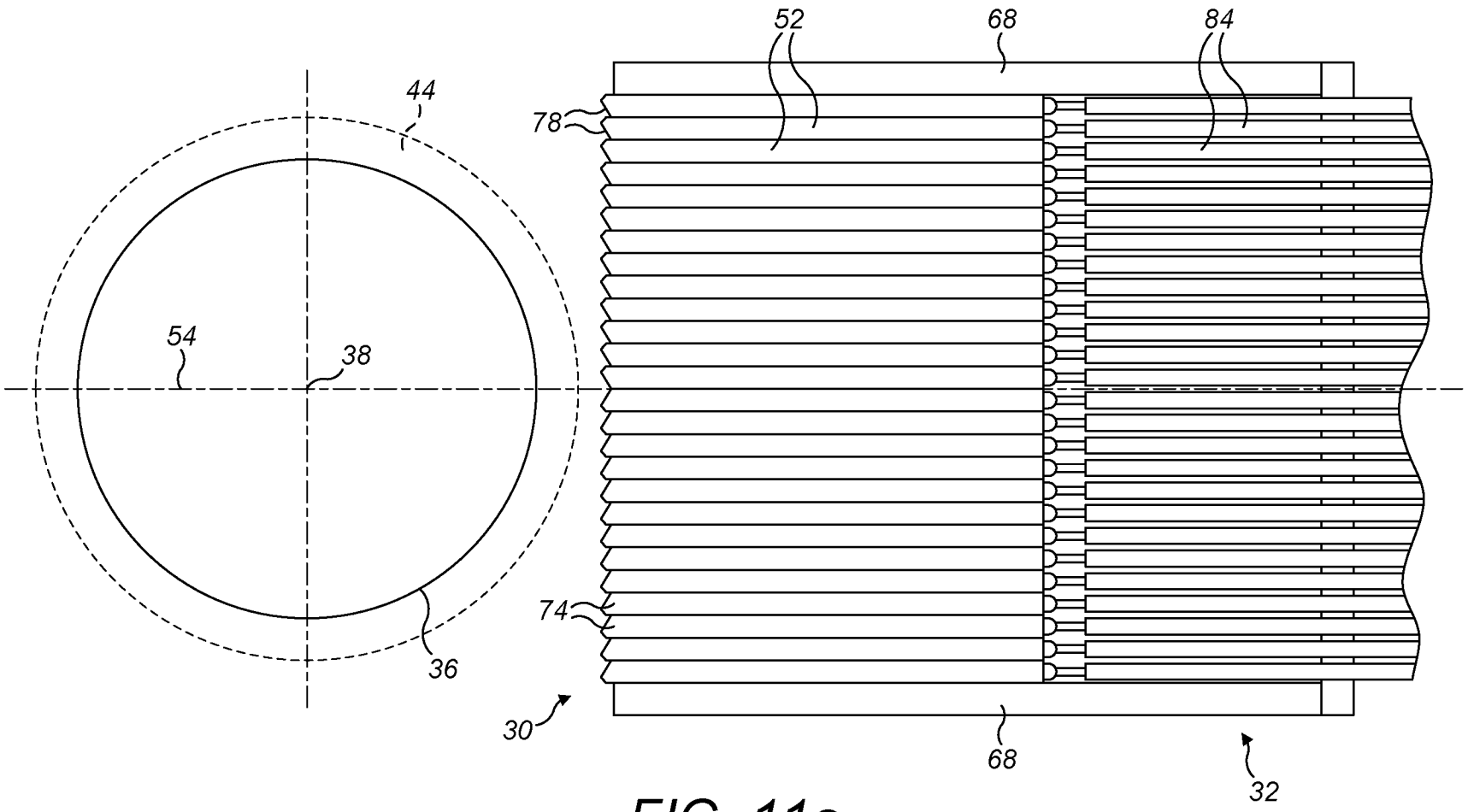
Figure 11B:
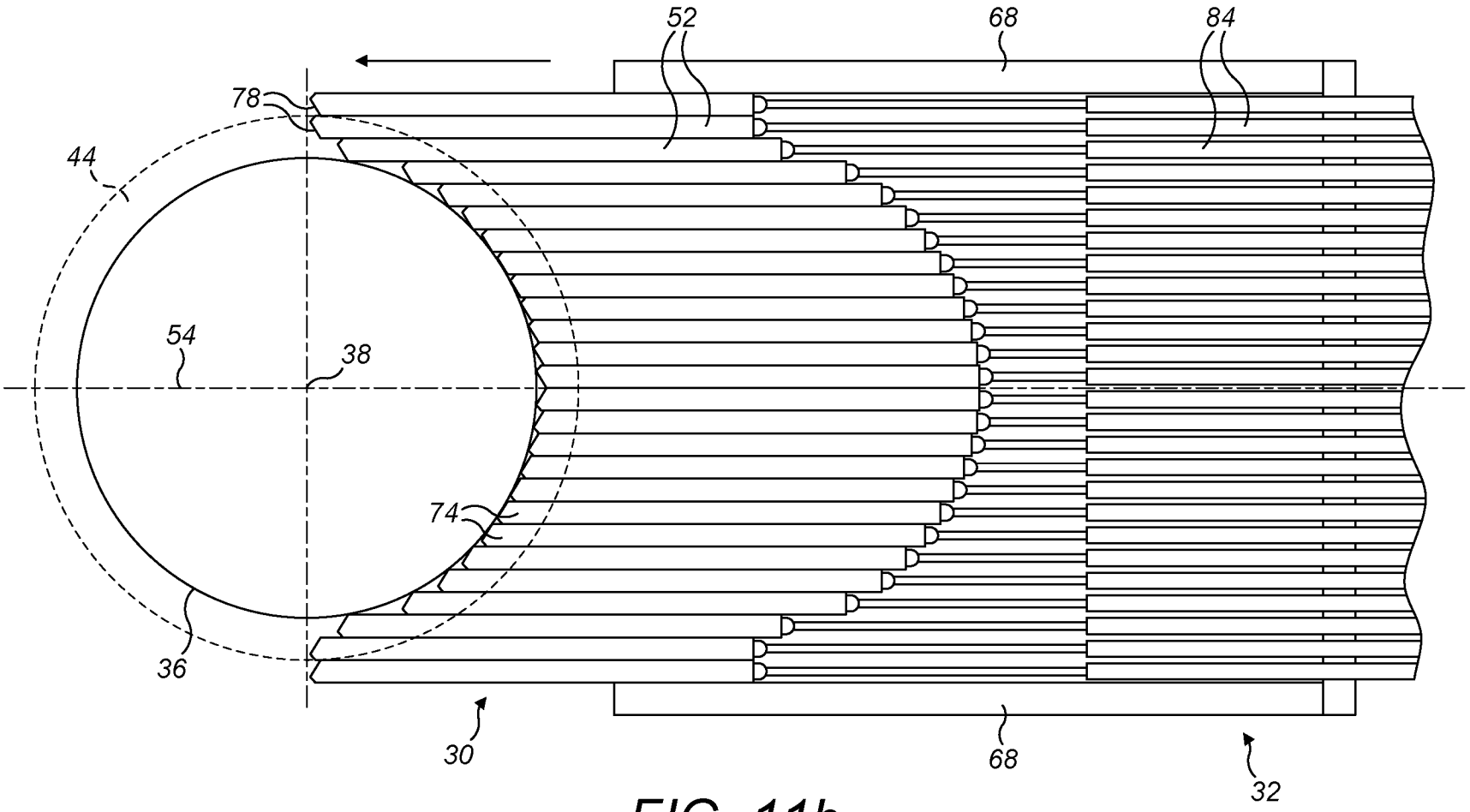
Figure 12A:
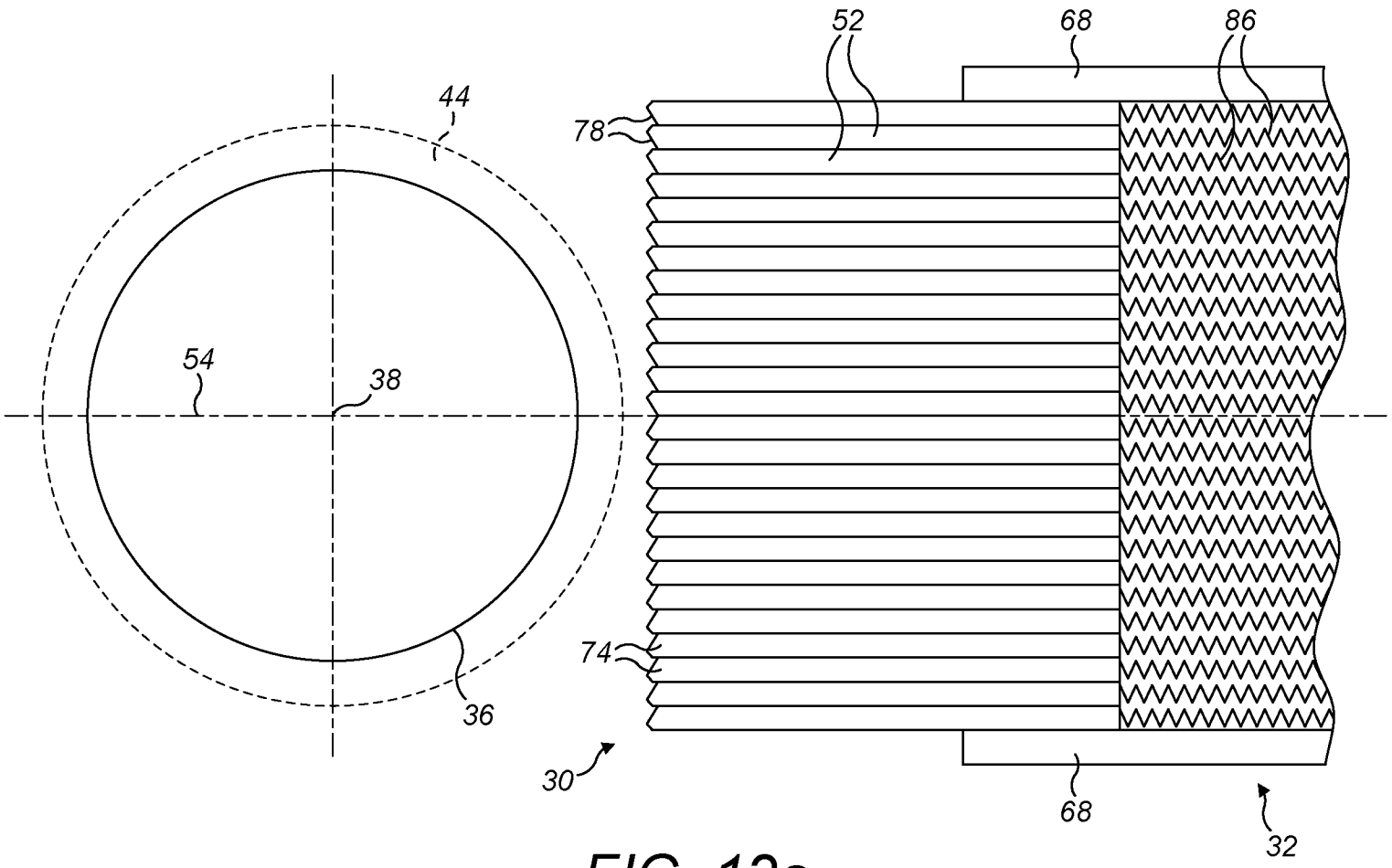
Figure 12B:
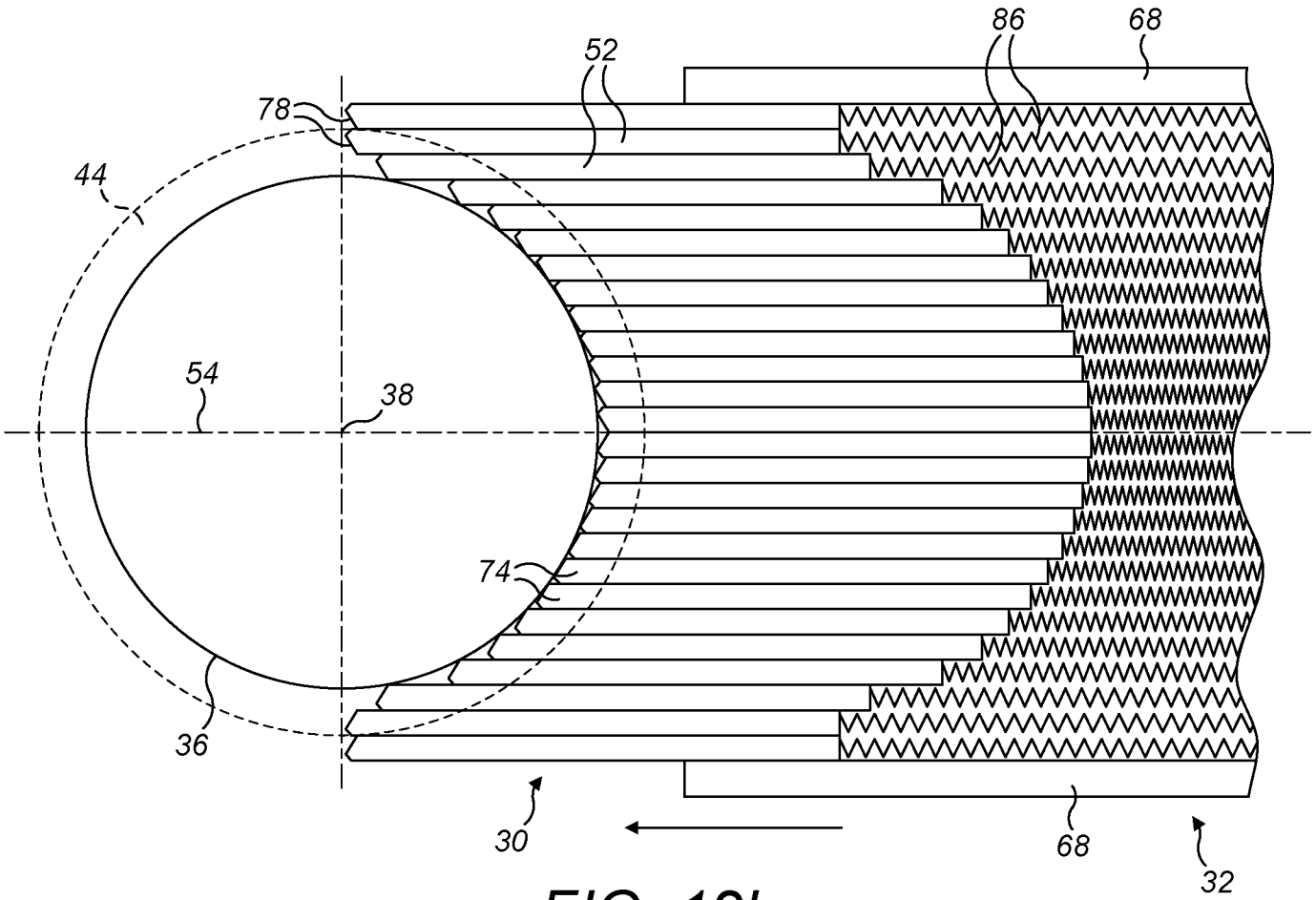
Figure 13:
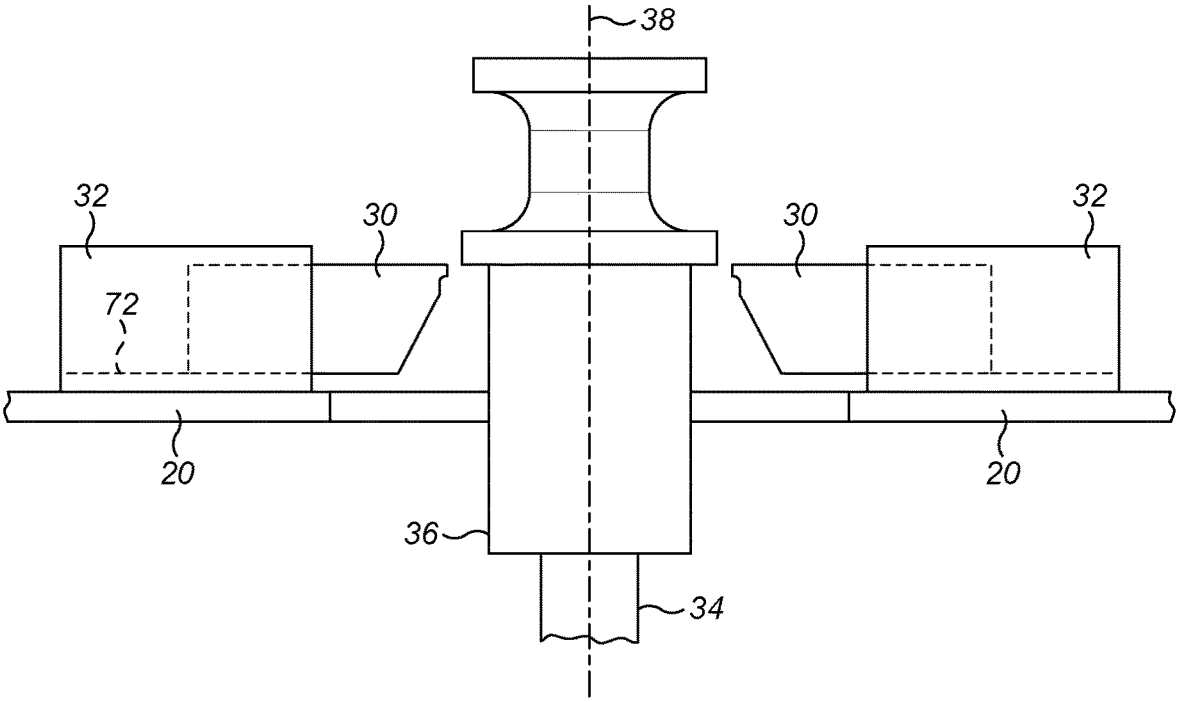
Figure 14:
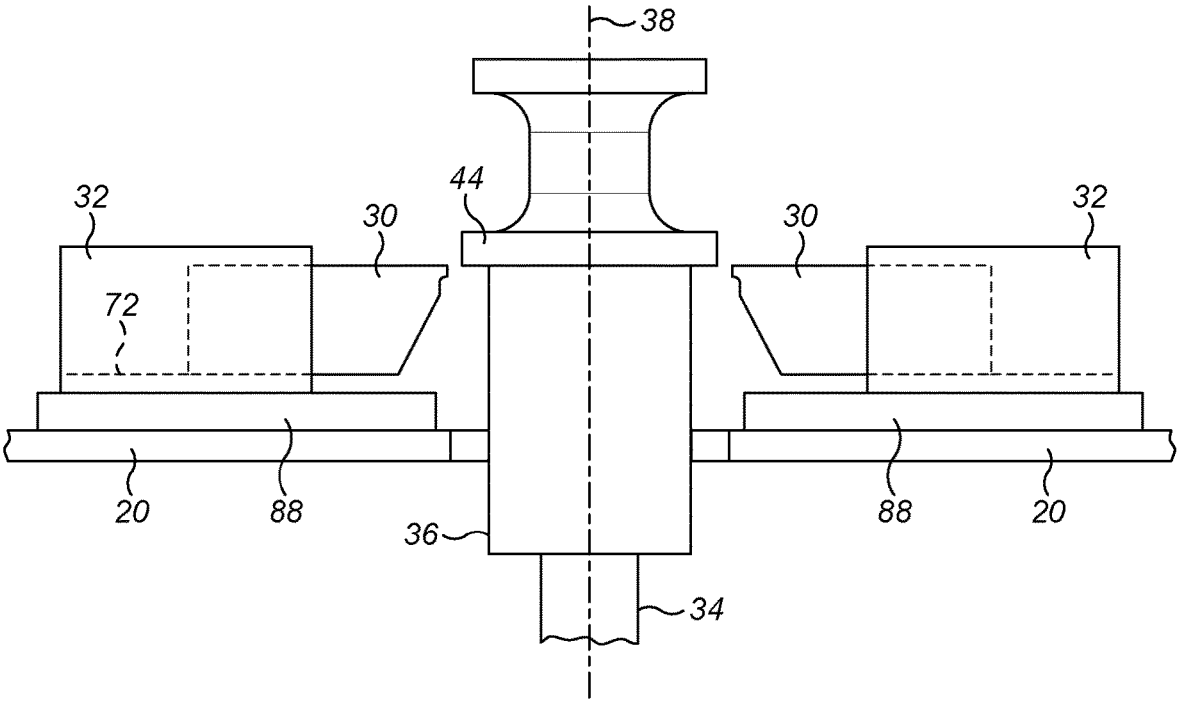
Figure 15:
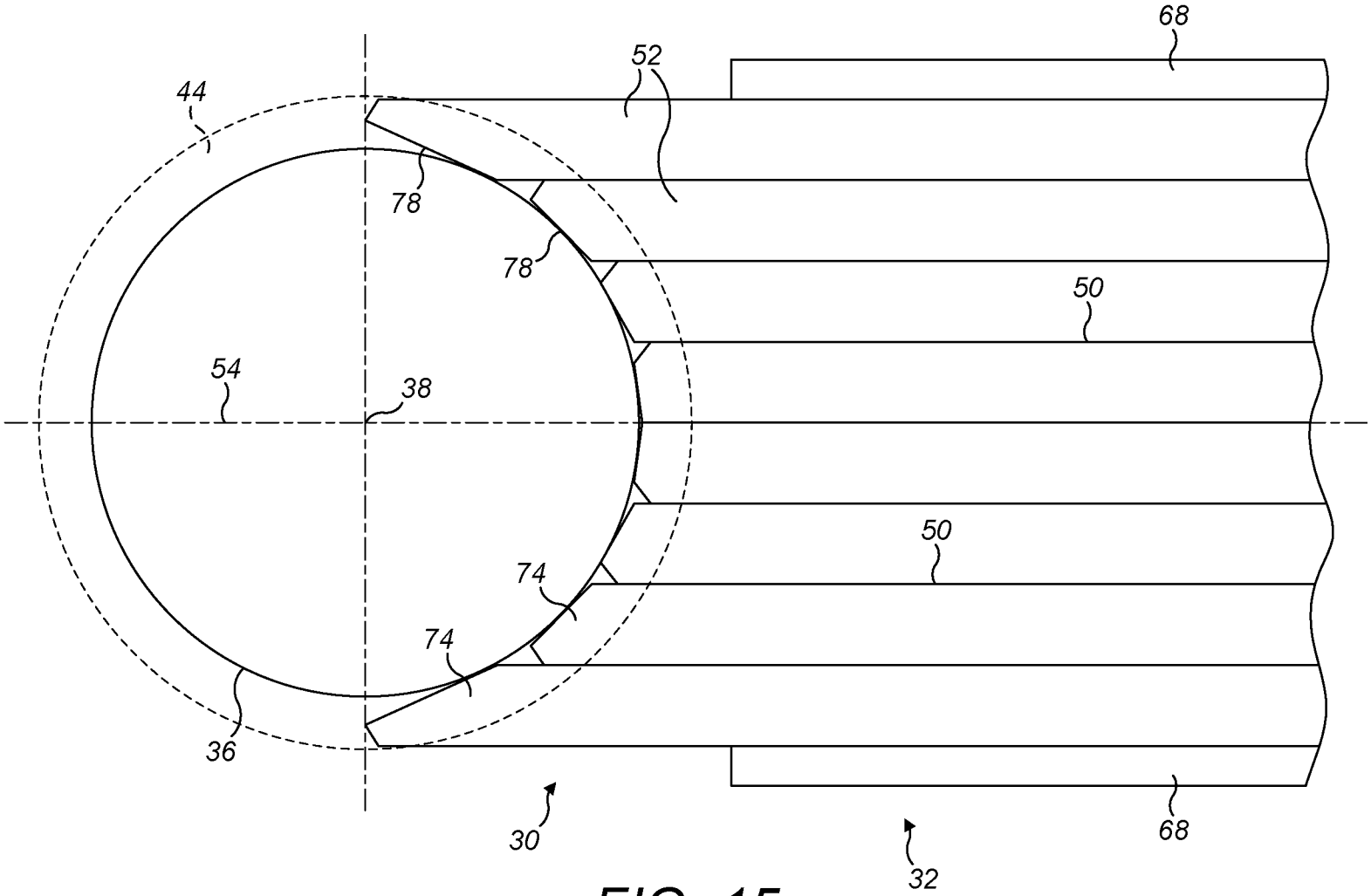
Figure 16:
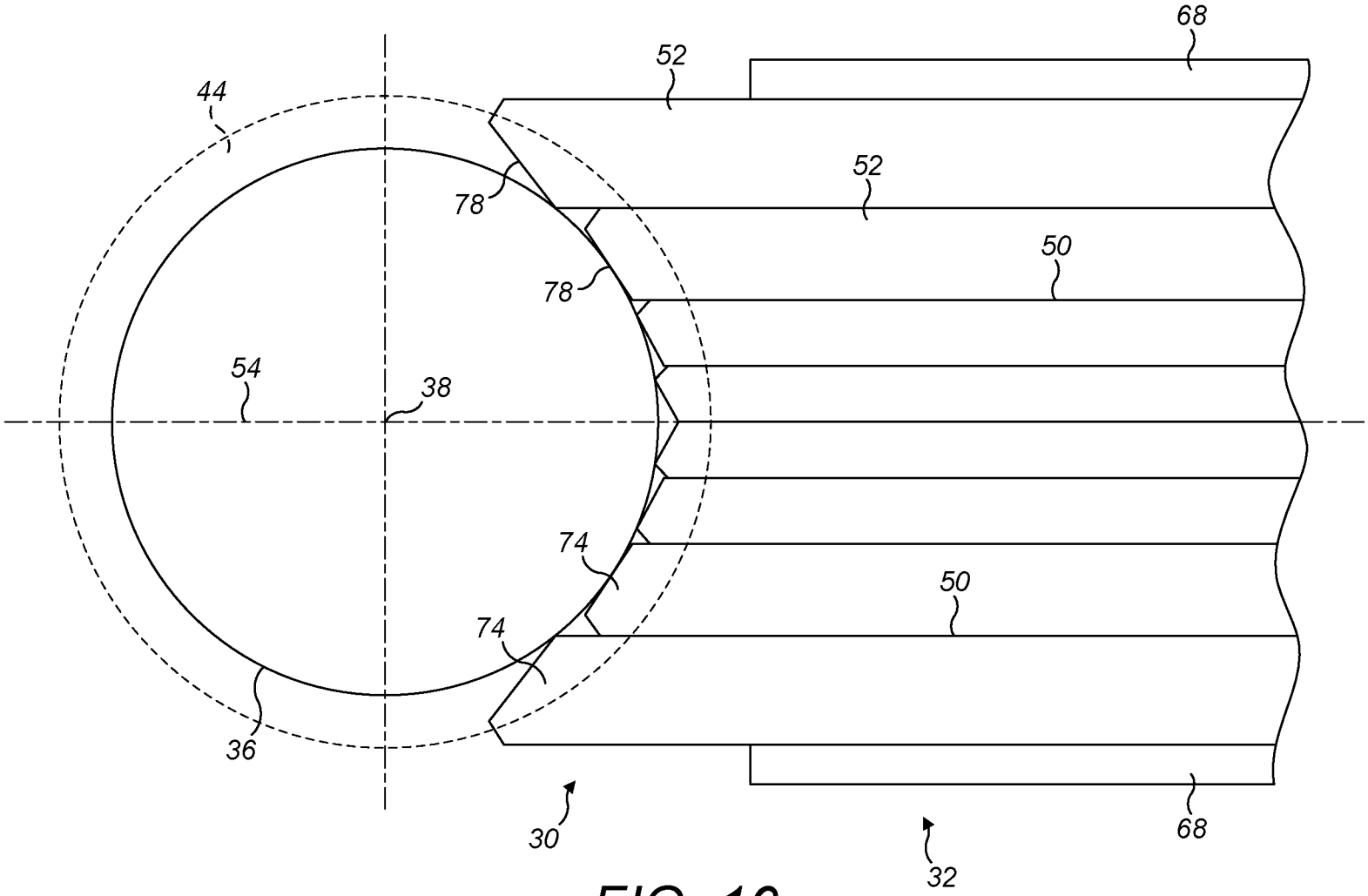
Figure 17:
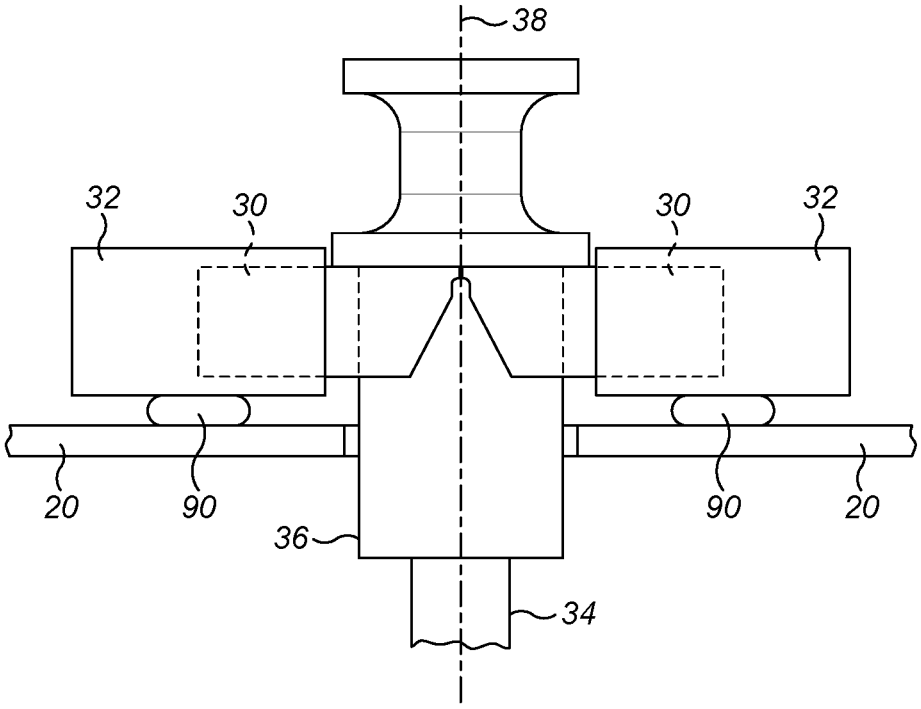
Figure 18:
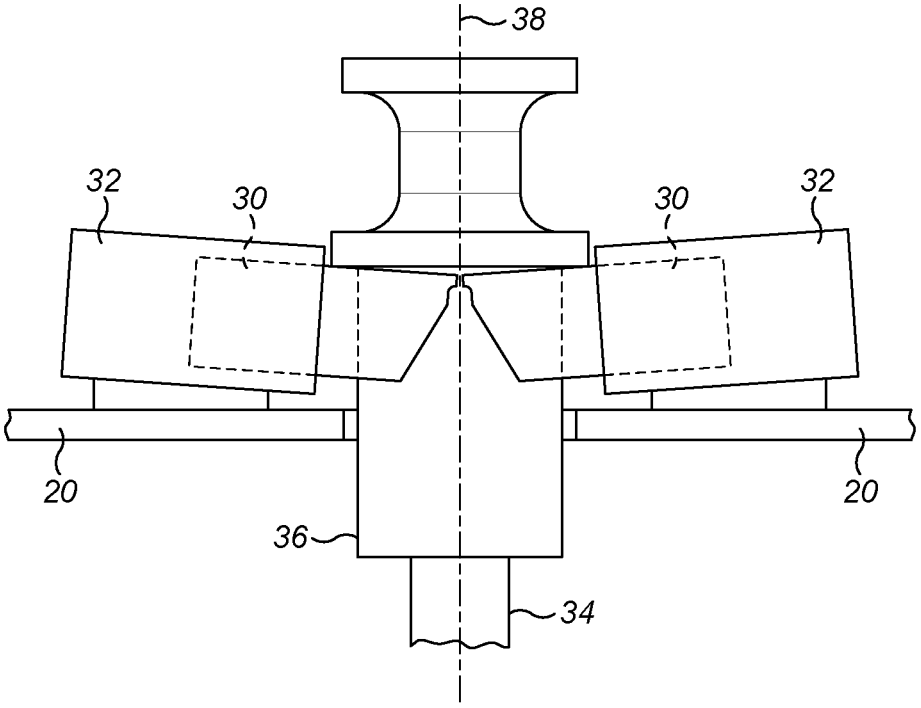

FIGS. 11*a* and 11*b* are schematic plan views showing a support block whose plate elements are advanced by actuators against an end fitting of a pipeline;

FIGS. 12*a* and 12*b* are schematic plan views showing a support block whose plate elements are biased by springs against an end fitting of a pipeline;

FIG. 13 is a schematic side view corresponding to FIG. 6 and showing support blocks within respective housings that are fixed to, and movable with, respective jaws of a hang-off-bushing;

FIG. 14 corresponds to FIG. 13 but shows the housings movable relative to respective jaws of the hang-off-bushing;

FIG. 15 is a schematic plan view showing a support block whose plate elements have differently inclined end faces;

FIG. 16 is a schematic plan view showing a support block whose plate elements have different thicknesses;

FIG. 17 is a schematic side view showing support blocks within respective housings that are pivotable relative to respective jaws of a hang-off-bushing; and FIG. 18 is a schematic side view showing support blocks that are tilted from the horizontal while maintaining their plate elements in substantially vertical planes.

Referring firstly to FIGS. 3 to 10 of the drawings, support blocks 30 of the invention are held in respective housings 32 mounted on respective jaw sections of a hang-off bushing 20. The support blocks 30 are therefore in mutual opposition around an elongate element 10 supported by the hang-off bushing 20, the element 10 in this example being a flexible pipeline 34 surrounded by an end fitting 36.

The pipeline 34 is coaxial with an upright launch axis 38 that is nominally vertical but may depart from the vertical, for example when laying a pipeline 34 from a tiltable lay tower of a vessel. In that case, the hang-off bushing 20 could, correspondingly, depart from a horizontal plane to remain orthogonal to the launch axis 38.

In the arrangement shown, there are two support blocks 30 equiangularly spaced around the launch axis 38, hence at an angle of 180° relative to each other. In other arrangements, there could be more support blocks 30, for example three or four support blocks 30 at angles of 120° or 90° to neighbouring support blocks 30 around the launch axis 38.

When advanced telescopically from within its housing 32 in a forward direction, that being a radially inward direction toward the launch axis 38, an end of each block 30 protrudes from its housing 32 in cantilever fashion and overhangs a central hole 22 in the bushing 20. A front face 40 of the protruding end of the block 30 engages with the pipeline 34, thus being an engagement face of the block 30. Specifically, an upper leading edge 42 of the front face 40 engages under a radially protruding flange 44 of the end fitting 36.

In a retracted or rest configuration, each block 30 is approximately cuboidal, comprising a planar upper face 46, a planar lower face 48 parallel to the upper face 46, and planar side faces 50 parallel to each other and orthogonal to the upper and lower faces 46, 48. The upper and lower faces 46, 48 are both nominally horizontal to match the plane of the hang-off bushing 20. The block 30 is of squat or shallow proportions, with the upper and lower faces 46, 48 being substantially larger than the side faces 50. In this example, however, the block 30 departs from a cuboidal shape in that its front face 40 is not orthogonal to the other faces 46, 48, 50. Instead, the front face 40 is inclined forwardly in an upward direction from the lower face 48 to the upper face 46. Thus, the upper face 46 of the block 30 is longer or deeper from front to back than the lower face 48. The resulting chamfered profile of the front face 40 better transfers loads from the end fitting 36 to the hang-off bushing 20. Also, as will be described later, the front face 40 of the block 30 is contoured and hence non-planar.

By virtue of the invention, the shape or contour of the block 30 and particularly its front face 40 reconfigures or adapts to match, complement or conform to the external shape or contour of the end fitting 36, especially the radius of curvature of the end fitting 36. Thus, the front face 40 adopts a female or concave contour in response to encountering the male or convex contour of the end fitting 36 when the block 30 is moved toward the launch axis 38. To enable reconfiguration in this way, each block 30 is divided into block portions that can move relative to each other. Specifically, each block 30 comprises an array of planar support elements being rigid leaves or plates 52, suitably made of steel. Each plate 52 can move relative to neighbouring plates 52 of the array in directions parallel to the upper, lower and side faces 50 of the block 30, hence forwardly and rearwardly.

Figure 7:
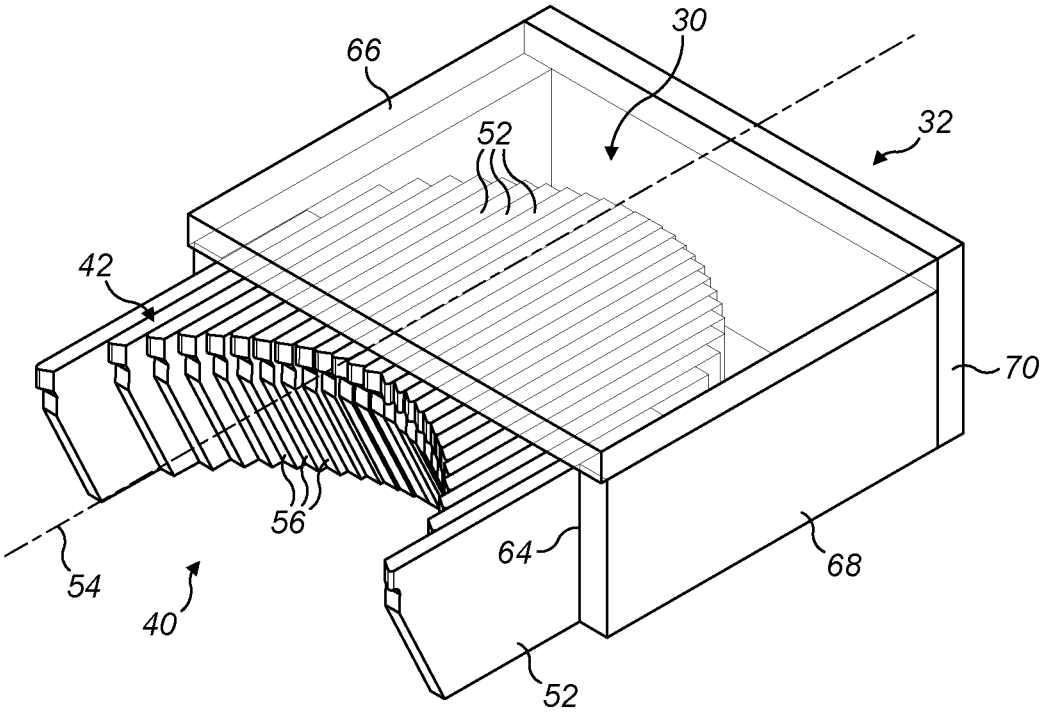
FIG. 7 is a schematic perspective view of a support block of the invention in a first configuration, also showing a surrounding housing.
Figure 8:
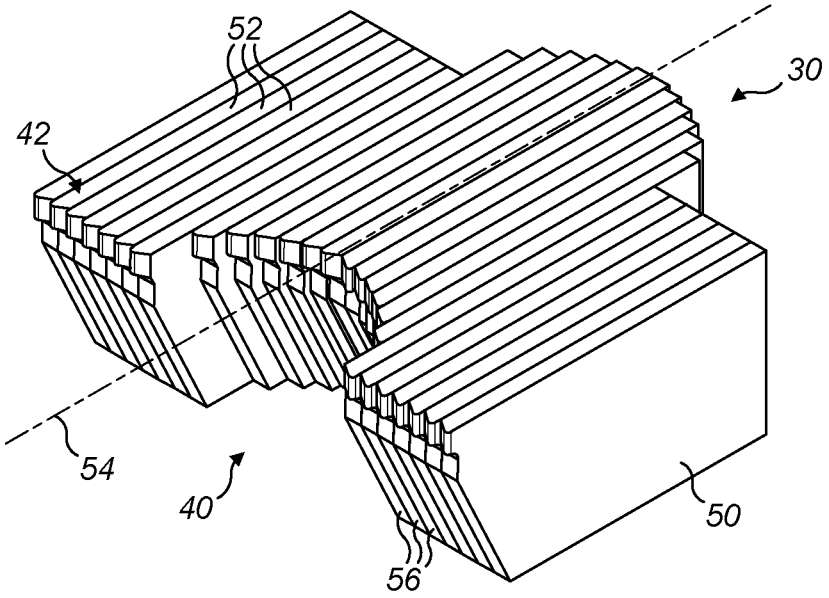
FIG. 8 shows the support block of FIG. 7 in a second configuration but omitting the housing.

The plates 52 are arranged in a horizontal stack, lying in upright, nominally vertical planes that are parallel to each other and to the forward direction in which the block 30 advances from the housing 32 toward the launch axis 38. The planes of the plates 52 are also substantially parallel to an upright plane 54 containing the launch axis 38 as shown in FIGS. 7 and 8. The plates 52 are all substantially identical to each other although, as will be explained, subsets of the plates 52 may have contoured front faces 56 that are oppositely handed or mirrored to suit the shape of the pipeline 34 on opposite sides of the plane 54 containing the launch axis 38.

Figure 9:
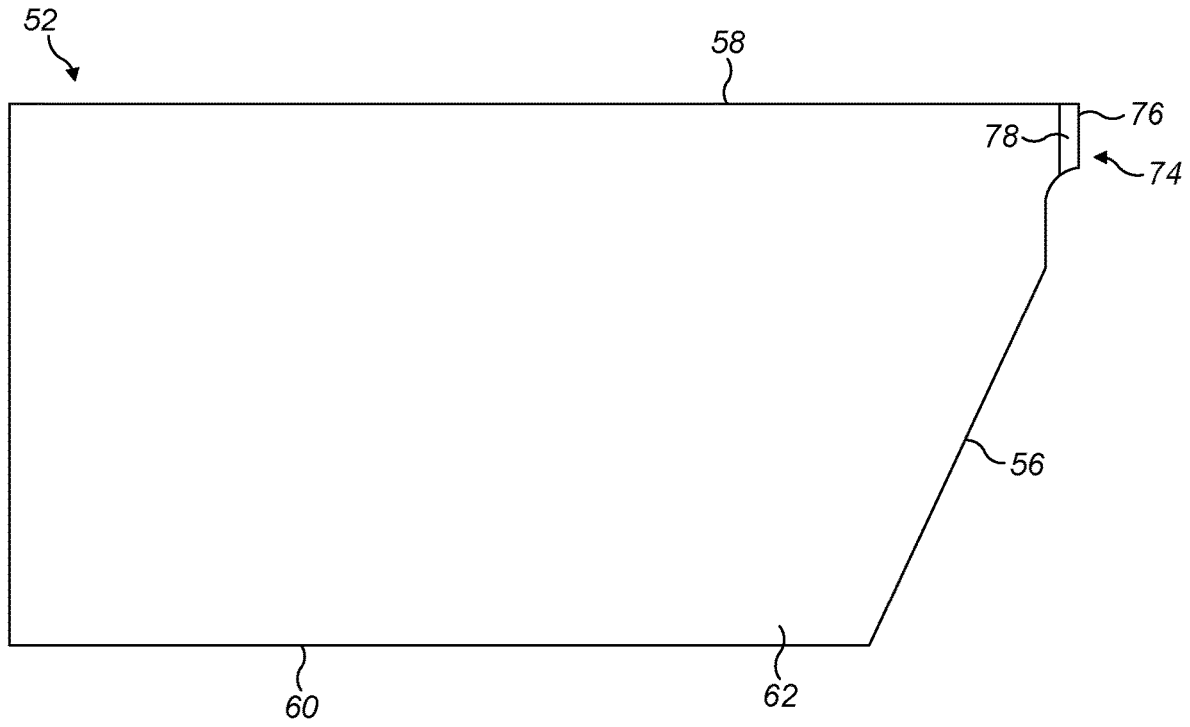
FIG. 9 is a side view of a plate element of the support block shown in FIGS. 3 to 8.
Figure 10:
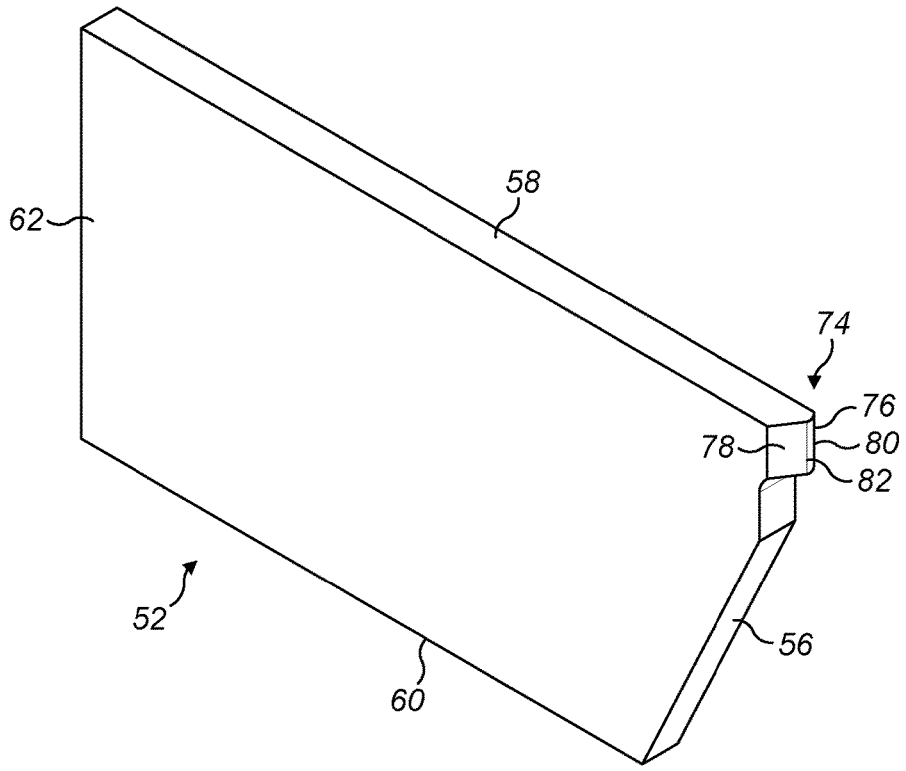
FIG. 10 is a perspective view of the plate element shown in FIG. 9.

FIGS. 9 and 10 show that like the block 30, each plate 52 is approximately cuboidal, comprising a planar upper face 58, a planar lower face 60 parallel to the upper face 58, and planar side faces 62 parallel to each other and orthogonal to the upper and lower faces 58, 60. The planes of the side faces 62 correspond to the planes of the plates 52. The front face 56 of each plate 52 is inclined forwardly in an upward direction to lend the aforementioned chamfered profile to the block 30.

The upper and lower faces 58, 60 of the plates 52 all lie in respective nominally horizontal common planes so that, collectively, the upper and lower faces 58, 60 of the plates 52 together define the upper and lower faces 46, 48 of the block 30. The side faces 62 of the plates 52 correspond to the side faces 50 of the block 30; indeed, the outermost plates 52 of the array define the side faces 50 of the block 30. In this instance, however, the plates 52 are thin in a lateral direction orthogonal to the side faces 50, in that their upper and lower faces 58, 60 are much smaller than the side faces 62. In this example, the side faces 62 of neighbouring plates 52 abut with sliding contact between them.

The block 30 is a close sliding fit in the housing 32, substantially filling the width and height of an aperture 64 of the housing 32 defined by a top wall 66 and side walls 68 of the housing 32, and in this case also by the hang-off bushing 20 that defines a base of the housing 32. Specifically, the housing 32 comprises upright side walls 68 outboard of, and in close sliding contact with, the outermost plates 52 of the array. Between them, the side walls 68 of the housing 32 thereby hold the plates 52 together in close sliding contact, so that the individual plates 52 are supported by neighbouring plates 52 of the block 30 and will not collapse, tilt or buckle under compressive loads applied by the suspended weight of the pipeline 34. Those loads are shared by the plates 52 in contact with the underside of the flange 44 of the fitting 36 and are transferred through the block 30 from the upper face 46 to the lower face 48 of the block 30 and from there to the hang-off bushing 20.

On an inner face, the side walls 68 correspond in height to the plates 52. The side walls 68 are joined by a top wall 66, shown in shadow in FIGS. 3, 4 and 7 and in dashed lines in FIG. 6, that is parallel to the hang-off bushing 20 and therefore to the upper face 46 of the block 30. The plates 52 are a sliding fit between the hang-off bushing 20 and the underside of the top wall 66. Thus, there is a sliding fit between the upper face 46 of the block 30 and the underside of the top wall 66 and an additional sliding fit between the lower face 48 of the block 30 and the upper surface of the hang-off bushing 20. These small sliding clearances prevent the block 30 or the plates 52 pivoting about a lateral axis under the downward weight load applied by the pipeline 34.

In this example, the housing 32 is closed by an optional back wall 70 that is orthogonal to the side walls 68, the top wall 66 and the hang-off bushing 20. The back wall 70 stiffens the housing 32 and leaves space on its forward side for plates 52 of the block 30 to retract into the housing 32 but does not interact directly with the plates 52. In other examples to be described with reference to later drawings, the housing 32 has a bottom wall 72 between the side walls 68, independent of the hang-off bushing 20. In those examples, the plates 52 are a sliding fit between the underside of the top wall 66 and the upper side of the bottom wall 72. Thus, there is a sliding fit between the lower face 48 of the block 30 and the upper side of the bottom wall 72.

FIGS. 7 and 8 show the ability of the block 30 to adapt to the circular-section shape of the fitting 36, and to adapt to fittings 36 of different diameters. In particular, FIG. 7 shows the front face 40 of the block 30 shaped to complement a relatively wide fitting 36 whereas FIG. 8 shows the front face 40 of the block 30 shaped to complement a relative narrow fitting 36. These drawings show the central position of the upright plane 54 that bisects the block 30 and that extends in the forward direction to contain the launch axis 38 shown in the preceding drawings. Plates 52 of the block 30 are retracted into the housing 32 to an extent determined by the curvature of the fitting 36, with plates 52 closer to the plane 54 therefore being retracted more than plates 52 further from the plane 54. The outermost plates 52 in FIG. 7 lie outside the radius of the fitting 36 and so are fully extended in the forward direction, although they would be retracted to some extent if the fitting 36 was any wider. Conversely, where the fitting 36 is relatively narrow as shown in FIG. 8, more of the outer plates 52 are fully extended.

FIGS. 9 and 10 show one of the plates 52 in isolation. The forward and upward inclination of the front face 40 is plainly apparent, as is the cuboidal relation of the other faces 58, 60, 62. These drawings also show that the upper end of the front face 40 comprises a forward extension 74 of the upper face 46 defining the upper leading edge 76 of the plate 52. In three dimensions, the forward extension 74 is prism-shaped, comprising a facet 78 and a stress-reducing chamfer 80 in respective nominally vertical planes that are orthogonal to the upper face 46. The facet 78 and the chamfer 80 meet at an upright edge 82 that is also orthogonal to the upper face 46 and that intersects the upper face 46 at the leading edge 76.

The angle of the facet 78 relative to the plane of the side face 50 reflects the curvature of the fitting 36 on opposite sides of the central plane shown in FIGS. 7 and 8. Thus, the plates 52 of the block 30 are arranged in two subsets divided by the central upright plane 54, with the facets 78 of one subset in mirrored relation to the facets 78 of the other subset. Specifically, the facets 78 of both subsets face inwardly, facing approximately toward the launch axis 38 in parallel directions that will intersect the circumference of a fitting 36 wide enough to encounter their plates 52.

As best appreciated in the plan views of FIGS. 11*b* and 12*b*, the oppositely angled facets 78 on opposite sides of the central upright plane 54 approximate to, or at least approach, tangential relationship with the circumference of the fitting 36. This increases the area of contact between the forward extensions 74 of the plates 52 and the underside of the flange 44, helpfully reducing stress when the block 30 bears the weight load of the pipeline 34 suspended from the fitting 36. The large number of plates 52 and the slimness of the plates 52 also helps to follow the curvature of the fitting 36 more closely and to maximise the area of load-supporting contact.

FIGS. 11*a* and 11*b* show that the plates 52 could be driven forwardly from the housing 32 and into engagement with the fitting 36 by individual actuators 84 acting on the back of each plate 52. In that case, the housing 32 can remain stationary while the plates 52 and hence the block 30 advance relative to the housing 32.

In an alternative approach shown in FIGS. 12*a* and 12*b*, the plates 52 are biased forwardly by respective springs 86. The springs 86 could of course take forms other than the coils springs shown schematically here. When the housing 32 carrying the extended plates 52 is moved forwardly, the plates 52 encountering the fitting 36 retract into the housing 32 to an extent determined by the curvature of the fitting 36. The springs 86 compress as the associated plates 52 retract.

Actuators 84 shown in FIGS. 11*a* and 11*b* or springs 86 shown in FIGS. 12*a* and 12*b* may react against the aforementioned optional back wall 70 of the housing 32.

It will be apparent from FIGS. 11*a*, 11*b*, 12*a* and 12*b* that the block 30 is firstly advanced forwardly until the leading edge 42 of the front face 40 comes into contact with the fitting 36, with contact initially being between the innermost plates 52 and the circumference of the fitting 36 closest to the central plane 54. The block 30 then begins to conform to the shape of the fitting 36 as the innermost plates 52 remain stationary while plates 52 outboard of them continue to advance forwardly with continued forward movement of the remainder of the block 30. Moving outwardly from the central plane 54, the plates 52 successively contact the circumference of the fitting 36 and therefore cannot advance further as the plates 52 outboard of them continue to advance forwardly. The result is that the leading edge 42 of the front face 40 has a stepped concavity corresponding to the convexity of the fitting 36. Eventually, any outermost plates 52 that do not intersect the circumference of the fitting 36 stop in alignment with a line that intersects the launch axis 38.

The housings 32 can be moved forwardly in accordance with FIGS. 12*a* and 12*b* in various ways. For example, FIG. 13 shows the housings 32 fixed to respective jaws of the hang-off-bushing 20 to be moved forwardly as the jaws are brought together. Alternatively, the housings 32 can be moved relative to the jaws of the hang-off bushing 20, for example on rails 88 mounted on the respective jaws and extending in the forward direction as shown in FIG. 14. FIGS. 13 and 14 also show a bottom wall 72 of the housing 32 that is distinct from the hang-off-bushing 20 as mentioned previously.

As noted previously, the preceding embodiments contemplate that the plates 52 of the block 30 may be identical apart from mirroring the facets 78 of their forward extensions 74. However, this is not necessarily the case. In this respect, FIG. 15 shows a simplified variant in which the block 30 has fewer plates 52, and facets 78 that vary in angle relative to the side faces 50 in accordance with the lateral distance from the central upright plane 54. Specifically, the facets 78 of the outer plates 52 are at a smaller or more acute angle to the side faces 50 than the facets 78 of the inner plates 52. Thus, the inclination of the plates 52 more closely matches the curvature of the fitting 36 and maximises the area of load-bearing contact with the flange 44, even though there are fewer plates 52 in the block 30.

FIG. 16 shows another variant in which plates 52 of the block 30 vary in accordance with lateral distance from the central upright plane 54. In this instance, outer plates 52 are thicker than inner plates 52 in a lateral direction, transverse to the forward direction. Thus, the outer plates 52 have greater resistance to deformation, such as twisting, under downward weight loads and so are better able to support the thinner inner plates 52 closer to the central plane 54 when the block 30 is advanced forwardly from the housing 32.

If the plates 52 are strong enough, an alternative arrangement may be possible in which the outer plates 52 are thinner than the inner plates 52, the better to follow the curvature of the fitting 36 away from the central plane 54. It would of course be possible to combine the approaches of FIGS. 15 and 16 by varying the angle of the facets 78 relative to the side faces 50 and by varying the thicknesses of the plates 52 in accordance with the distance from the central plane 54.

Moving on to FIG. 17, this shows a variant in which the housing 32 is not fixed rigidly but can instead pivot relative to the hang-off bushing 20. For example, the housing 32 can be mounted to the hang-off bushing 20 via elastomeric mounts 90, gimbals or other pivot arrangements. Pivotal movement of the housing 32 may thereby be permitted about horizontal and/or vertical axes. This allows the housing 32 to realign to reorient the block 30 when compensating for slight misalignment between the launch axis 38 and the hang-off system. Movement of the housing 32 relative to the hang-off bushing 20 can be passive in response to the block 30 encountering the fitting 36 or can be active, in the sense of being driven by actuators to compensate for misalignment between the launch axis 38 and the hang-off system.

Turning finally to FIG. 18, this shows that the plates 52 need not necessarily only move in horizontal directions orthogonal to the launch axis 38. Here, the housings 32 and the plates 52 are tilted downwardly toward the launch axis 38, for example to use gravity to assist deployment of the plates 52 from the housings 32.

The plates 52 may also tilt, or be driven to tilt, in vertical planes to compensate for slight tilting of the supported part or poor planarity of the interface. For example, blocks 30 or plates 52 on one side of the launch axis 38 could be tilted slightly downwardly and blocks 30 or plates 52 on an opposite side of the launch axis 38 could be tilted slightly upwardly, potentially with matching inclination to the horizontal. Another approach to this issue would be to lower a block 30 and/or to raise a block 30 relative to other blocks 30 to compensate for a slightly misaligned pipeline.

Many other variations are possible within the inventive concept. For example, the plates 52 need not be in sliding contact with each other and/or with the housing 32 and could be supported for movement in another way, for example on individual rails or individual bearings. Indeed, the housing 32 may not be necessary if the plates 52 are supported in a different way, for example with individual supports. Also, the plates 52 need not necessarily be parallel and could, for example, converge on the launch axis 38 in plan view while remaining in substantially vertical planes.

With individual control of the positions of the plates 52 or other portions of a support block 30, it would be possible to configure the contour of the front face 40 to suit a particular fitting 36 before bringing the support block 30 into contact with the fitting 36. Such control could, for example, be achieved by selective operation of individual actuators 84.

The invention claimed is:

1. A hang-off system comprising at least two support blocks that are each movable forwardly toward a launch axis for engagement with an elongate element being laid from a vessel into water, wherein:

each support block comprises an array of plates that together define an engagement face of the support block and are movable relative to each other to conform a contour of the engagement face to a contour of the element;

each plate comprises mutually parallel upright side faces joined by an upper face that is narrower than either of the side faces of that plate; and the upper faces of the plates together define an upper face of each support block.

2. The system of claim 1, wherein each plate further comprises a lower face that is parallel to the upper face, the lower faces of the plates together defining a lower face of each support block.

3. The system of claim 1, wherein the plates of each support block are movable relative to each other in respective upright planes.

4. The system of claim 3, wherein said planes are mutually parallel.

5. The system of claim 4, wherein said planes are parallel to a plane containing the launch axis.

6. The system of claim 1, wherein the side faces of each plate are joined by a front face, the front faces of the plates together defining the engagement face of each support block.

7. The system of claim 6, wherein the front face of each plate is shaped to define a facet that is angled acutely relative to planes of the side faces of that plate.

8. The system of claim 7, wherein the facets of one subset of the plates of each support block are in mirror relation to the facets of another subset of the plates of each support block, and the facets of both of those subsets face toward the launch axis.

9. The system of claim 8, wherein the subsets are separated by an upright plane that bisects each support block and contains the launch axis.

10. The system of claim 1, wherein the plates of each support block are disposed side-by-side in a horizontally-extending array.

11. The system of claim 1, further comprising housings that each constrain the plates of a respective one of the support blocks against movement transverse to a forward direction of that support block and that define apertures through which the respective support blocks can be advanced forwardly from the housings toward the launch axis.

12. The system of claim 11, wherein each housing comprises side walls disposed on respective sides of the respective support block that constrain lateral movement of the plates.

13. The system of claim 11, wherein each housing further comprises a top wall disposed above the respective support block that constrains upward movement of the plates.

14. The system of claim 1, further comprising actuators acting on the plates of each support block to drive the forward movement of the plates.

15. The system of claim 1, wherein the plates of each support block are biased forwardly.

16. The system of claim 1, wherein each support block is mounted on a respective jaw of a hang-off bushing.

17. The system of claim 16, wherein each support block is movable forwardly relative to the respective jaw of the hang-off bushing.

18. The system of claim 16, wherein each support block is pivotable about horizontal and/or vertical axes relative to the respective jaw of the hang-off bushing.

19. The system of claim 1, wherein the engagement face of each support block is inclined forwardly and upwardly toward a respective upper leading edge.

20. A lay system comprising the hang-off system of claim 1.

21. A vessel comprising the hang-off system of claim 1.

22. A method of hanging-off an elongate element being laid from a vessel into water, the method comprising:

advancing first and second portions of at least two support blocks in parallel planes into contact with the element beneath an outwardly-projecting formation of the element, wherein the first and second portions of each support block are advanced in respective inward directions toward a launch axis, the inward directions being parallel to said parallel planes;

effecting relative displacement between said portions of each support block in said parallel planes to conform a contour of each support block to an abutting contour of the elongate element; and hanging-off the element from said portions of each support block in contact with an underside of the outwardly-projecting formation.

23. The method of claim 22, comprising effecting relative displacement between said portions after bringing the first portion into contact with the element.

24. The method of claim 23, comprising advancing the first portion of each support block into contact with the element and with the first portion then stationary relative to the element, advancing the second portion of each support block into contact with the element.

25. The method of claim 22, comprising effecting relative displacement between said portions before bringing either portion into contact with the element.

26. The method of claim 22, comprising advancing a leading edge of the second portion beyond a leading edge of the first portion.

27. The method of claim 22, wherein the direction of advancement is parallel to an upright plane containing a launch axis of the element.

28. The method of claim 22, comprising constraining said portions against transverse movement and/or upward movement.

29. The method of claim 22, comprising driving movement of said portions individually.

30. The method of claim 22, comprising biasing said portions toward the element and effecting relative movement between said portions against that bias.

31. The method of claim 22, comprising moving each support block with a supporting jaw of a hang-off bushing.

32. The method of claim 31, comprising moving each support block relative to a supporting jaw of the hang-off bushing.

33. The method of claim 32, comprising pivoting each support block about horizontal and/or vertical axes relative to the supporting jaw of the hang-off bushing.

* * * * *